US009155381B2

(12) United States Patent
Maslow et al.

(10) Patent No.: US 9,155,381 B2
(45) Date of Patent: Oct. 13, 2015

(54) GUIDES FOR PAINTING

(71) Applicant: Easy Pro Products, LLC, Saint Paul, MN (US)

(72) Inventors: Stephen Maslow, St. Paul, MN (US); Paul Henrich, Lino Lakes, MN (US)

(73) Assignee: Easy Pro Products, LLC, Saint Paul, MN (US)

( * ) Notice: Subject to any disclaimer, the term of this patent is extended or adjusted under 35 U.S.C. 154(b) by 171 days.

(21) Appl. No.: 13/796,542

(22) Filed: Mar. 12, 2013

(65) Prior Publication Data

US 2014/0075693 A1 Mar. 20, 2014

Related U.S. Application Data

(60) Provisional application No. 61/702,895, filed on Sep. 19, 2012.

(51) Int. Cl.

| | |
|---|---|
| ***A47L 1/00*** | (2006.01) |
| ***A46B 17/08*** | (2006.01) |
| ***A46B 5/02*** | (2006.01) |
| ***B25G 1/10*** | (2006.01) |

(52) U.S. Cl.
CPC . *A46B 17/08* (2013.01); *A46B 5/02* (2013.01); *B25G 1/102* (2013.01); *A46B 2200/202* (2013.01)

(58) Field of Classification Search
USPC ..... 15/246, 247, 248.1, 256.5
See application file for complete search history.

(56) References Cited

U.S. PATENT DOCUMENTS

| | | | | |
|---|---|---|---|---|
| 209,279 | A * | 10/1878 | Marsden | 15/168 |
| 1,888,930 | A | 11/1932 | McMillan | |
| 3,023,439 | A | 3/1962 | Danley | |
| 3,153,801 | A | 10/1964 | Weiss et al. | |
| 3,819,779 | A | 6/1974 | Pharris et al. | |
| 4,454,623 | A | 6/1984 | O'Halloran | |
| 4,481,689 | A | 11/1984 | Westmoreland | |
| 4,490,875 | A | 1/1985 | Grunz | |
| 4,495,669 | A | 1/1985 | Hooper | |
| 4,751,762 | A | 6/1988 | Meimeteas | |
| 5,084,932 | A * | 2/1992 | Zanchi | 15/248.1 |
| 5,249,330 | A | 10/1993 | Janssen | |
| 5,339,482 | A | 8/1994 | Desimone et al. | |
| 5,343,585 | A | 9/1994 | Howell | |
| 5,446,941 | A | 9/1995 | Kelsay | |
| 5,470,162 | A | 11/1995 | Rubin | |

(Continued)

FOREIGN PATENT DOCUMENTS

| | | |
|---|---|---|
| EP | 0822769 | 4/1996 |
| EP | 1153555 | 11/2001 |

(Continued)

*Primary Examiner* — Lee D Wilson
*Assistant Examiner* — Shantese McDonald
(74) *Attorney, Agent, or Firm* — Curtis B. Herbert; Dardi & Herbert, PLLC

(57) ABSTRACT

A sleeve for partially covering a paint brush, the sleeve comprising a first substantially flat face and a second substantially flat face joined to each other by side faces, a first opening for receiving a ferrule of a paint brush and a second opening for receiving a shank portion of the paint brush, and at least one guide chosen from the group consisting of a thumb guide, an index finger guide, and a middle finger guide. A brush comprising at least one guide chosen from the group consisting of a thumb guide, an index finger guide, and a middle finger guide.

23 Claims, 10 Drawing Sheets

(56) References Cited

U.S. PATENT DOCUMENTS

| | | | | |
|---|---|---|---|---|
| 5,556,092 | A | 9/1996 | Theken | |
| 5,615,445 | A | 4/1997 | Kelsay et al. | |
| 5,761,759 | A | 6/1998 | Leversby et al. | |
| 5,761,767 | A | 6/1998 | Barton | |
| 5,920,943 | A | 7/1999 | Barker | |
| 6,138,313 | A | 10/2000 | Barton et al. | |
| 6,145,151 | A | 11/2000 | Herron et al. | |
| 6,401,290 | B1 * | 6/2002 | Barton et al. | 15/143.1 |
| 6,473,929 | B1 | 11/2002 | Learned, III | |
| 6,742,213 | B1 | 6/2004 | Vaes | |
| D562,010 | S * | 2/2008 | Goulet et al. | D4/199 |
| 2005/0150083 | A1 | 7/2005 | Roberts | |
| 2005/0278898 | A1 | 12/2005 | Tillim | |
| 2008/0223810 | A1 | 9/2008 | Garcia | |
| 2012/0021151 | A1 * | 1/2012 | Tatarka et al. | 428/35.1 |
| 2014/0304931 | A1 * | 10/2014 | Cox et al. | 15/159.1 |

FOREIGN PATENT DOCUMENTS

| | | |
|---|---|---|
| EP | 2308654 | 4/2011 |
| GB | 351858 | 7/1931 |
| GB | 2378895 | 2/2003 |
| WO | 2007045821 | 4/2007 |
| WO | 2010115428 | 10/2010 |

* cited by examiner

GUIDES FOR PAINTING

CROSS REFERENCE TO RELATED APPLICATIONS

This patent application claims priority to Provisional Patent Application U.S. Ser. No. 61/702,895 filed Sep. 19, 2012, which is hereby incorporated by reference herein.

TECHNICAL FIELD

The Technical Field relates to painting and painting materials or processes.

BACKGROUND

Paint brushes are familiar objects used to paint. They typically have a handle connected to a ferrule that holds bristles or other materials that are useful for holding and applying paint.

SUMMARY

There are multiple problems with paint brushes. One problem is that they are hard to hold and grip because of the materials that they are made of such as metal ferrules and wood handles. Secondly, most people do not know the proper or effective way to hold a paint brush. Further, prolonged use of a paint brush can cause cramping and soreness in a user's hand and wrist.

Provided herein are inventions that solve these problems. One embodiment is a pliable slip-on sleeve with finger guides to show the proper way to hold a paint brush.

The molded sleeve provides a cushioned grip for maximum comfort. The finger guides are placed so that the user's thumb is placed on one side of the handle, the pointer (index) finger on top of the brush, and the middle finger opposite the thumb. Another embodiment places the depressions directly on the brush. The guides may be, e.g., depressions and/or areas bounded by ridges to set-off the area visually and/or by touch.

The advantages of using these guides are a reduced strain on the hand and wrist. The guides also show novice painters how to properly hold a paint brush, thus making it easier to paint a straight line. Finally the guides may be provided on a sleeve that is cleanable, re-usable and sized to fit most brushes.

These and other embodiments are depicted and/or described herein.

DETAILED DESCRIPTION

Figure 1:
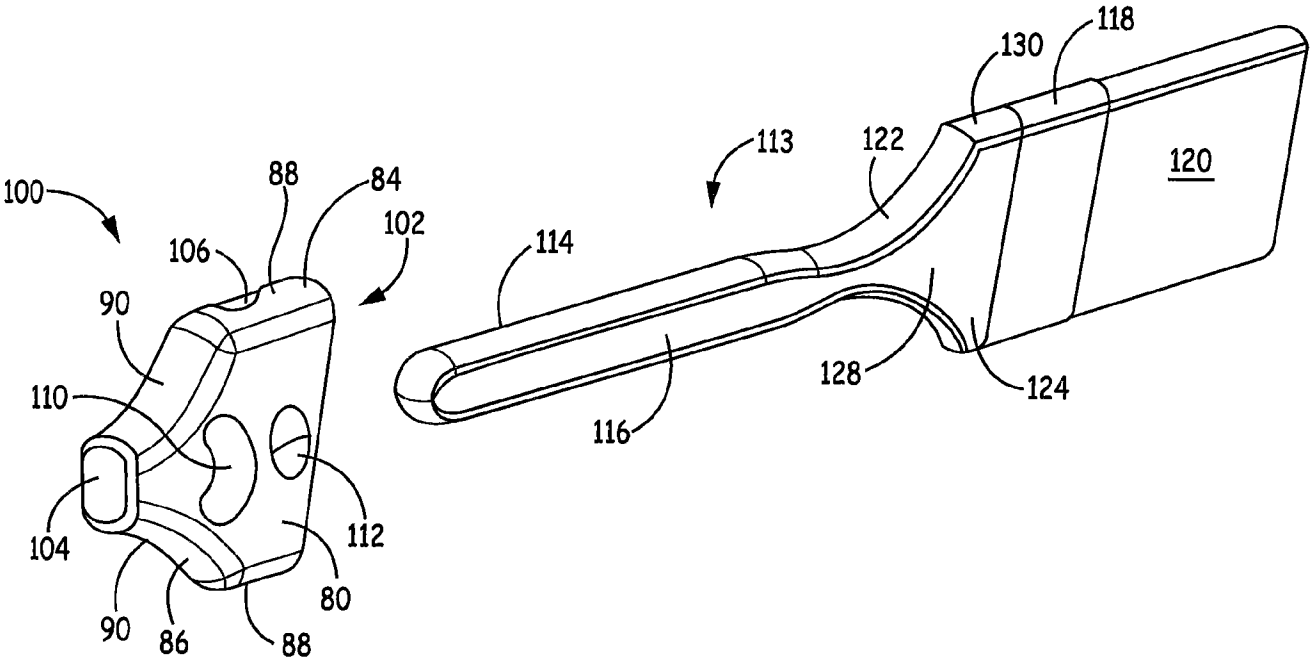
FIG. 1 is a perspective view of an embodiment of a sleeve in relation to a paint brush that receives the sleeve.
Figure 2:
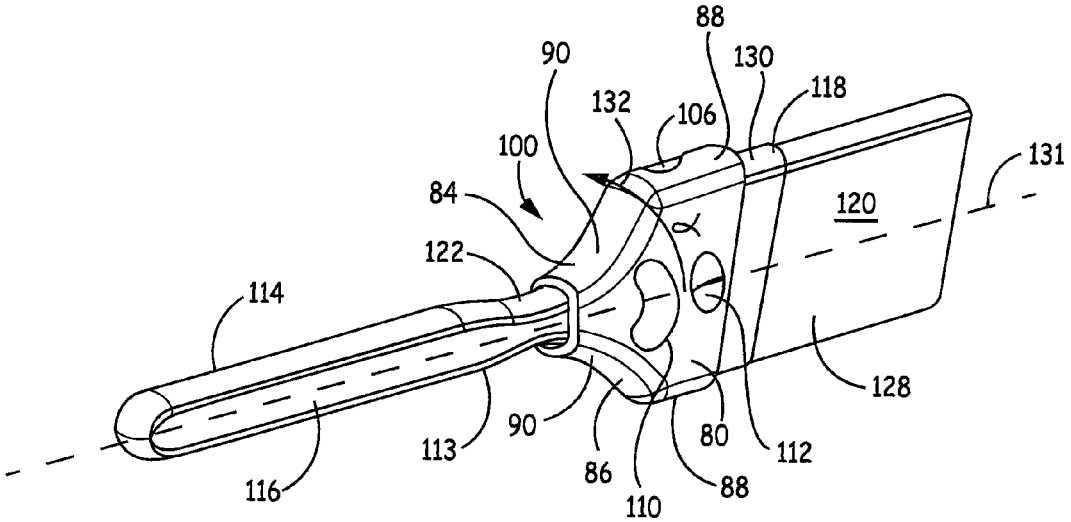
FIG. 2 is a perspective view of the right-hand side of the embodiment of FIG. 1, with the sleeve in place over the brush for a right-handed user.
Figure 3:
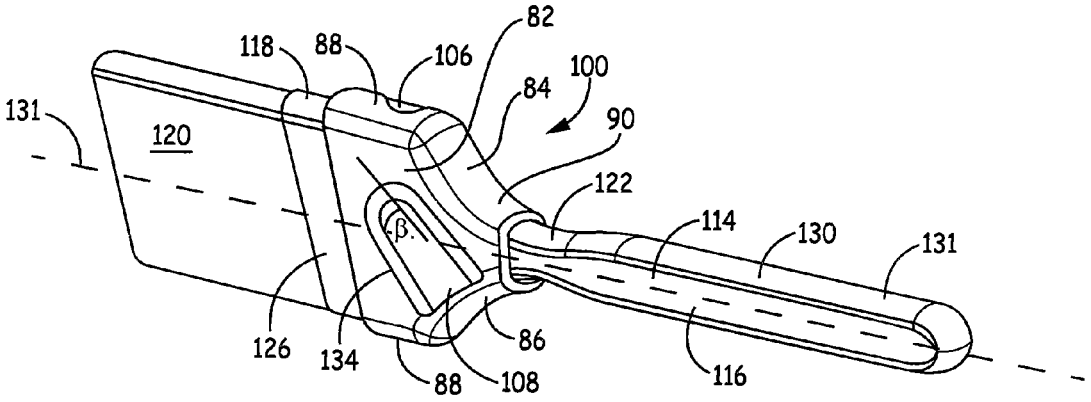
FIG. 3 is a perspective view of the embodiment of FIG. 2, showing the left-hand side.

Referring to FIGS. 1-3, sleeve 100 is depicted having ferrule opening 102, shank opening 104, index finger guide 106, thumb guide 108, first middle finger guide 110, and a second (distal) middle finger guide 112. A paint brush 113 is also depicted, with the paint brush 113 having a handle 114, ferrule 118, and filament 120. Filament 120 is used to apply paint and may be a plurality of bristles, a foam pad, or other filaments known for use in a paint brush. Handle 114 has narrow shank portion 122 and wide portion 124 that is attached to ferrule 118. There is a transition from the shank to the wide portion that, as depicted, is a taper although the transition may be otherwise created. Ferrule 118 contacts filaments 120 and is involved in securing the filaments to the handle, as is well known in these arts. Brush 113 has first side 126 and second side 128 separated by thickness 130. Sleeve 100 has a substantially flat first side 80 and a substantially flat second side 82 joined together by connecting faces 84, 86. Faces 84, 86 have substantially straight faces 88 that join to arcuate faces 90 that extend to shank opening 104. Straight faces 88 substantially overlay the brush ferrule when the sleeve is in use. The sleeve has an interior space that has a portion for receiving at least a part of the ferrule of a brush and covering at least part of the ferrule and a portion for covering a wide portion of the brush and the tapered area of the brush handle. The interior space may further cover at least part of the narrow shank portion.

FIG. 2 depicts sleeve 100 in position over brush 113. Brush handle 114 has central axis 130 that passes through the center of shank 122 and wide portion 124. First middle finger guide 110 forms an angle alpha 132 of about 120 to about 150 degrees relative to central axis 131, as measured from the proximal portion of the axis. Middle finger guide 110 has a gently curved shape and two wings; an axis taken through the center of one of the wings of the guide may be used to approximately calculate said angle alpha 132. The angle alpha may range from about 90 degrees to about 170 degrees; artisans will immediately appreciate that all values and ranges between the explicitly stated values are contemplated. The distal middle finger guide 112, which is distal relative to the first middle finger guide, is located above said central axis. Index guide 106 is located over thickness 130 of brush 113. Sleeve 100 is received by brush 113 and is securely fit to brush 113 at a location that is at least partially over ferrule 118 (as depicted) and extends to shank 122 (as depicted) and may alternatively extend farther up the shank and/or farther down the ferrule.

FIG. 3 depicts sleeve 100 in place over brush 113, with brush 113 being viewed from second side 128. Thumb guide 108 of the sleeve is visible, and is located partially over ferrule 118 and partially over wide portion 124. Thumb guide 108 has an angle beta 134 of about 45 degrees relative to central axis 131 when the angle is measured from the distal part of the axis as depicted. Index guide 106 is also visible on thickness 130. The angle beta may range from about 25 degrees to about 80 degrees; artisans will immediately appreciate that all values and ranges between the explicitly stated values are contemplated. As is evident index guide 106 is offset towards the middle finger side and away from the thumb side of the sleeve.

Figure 4:
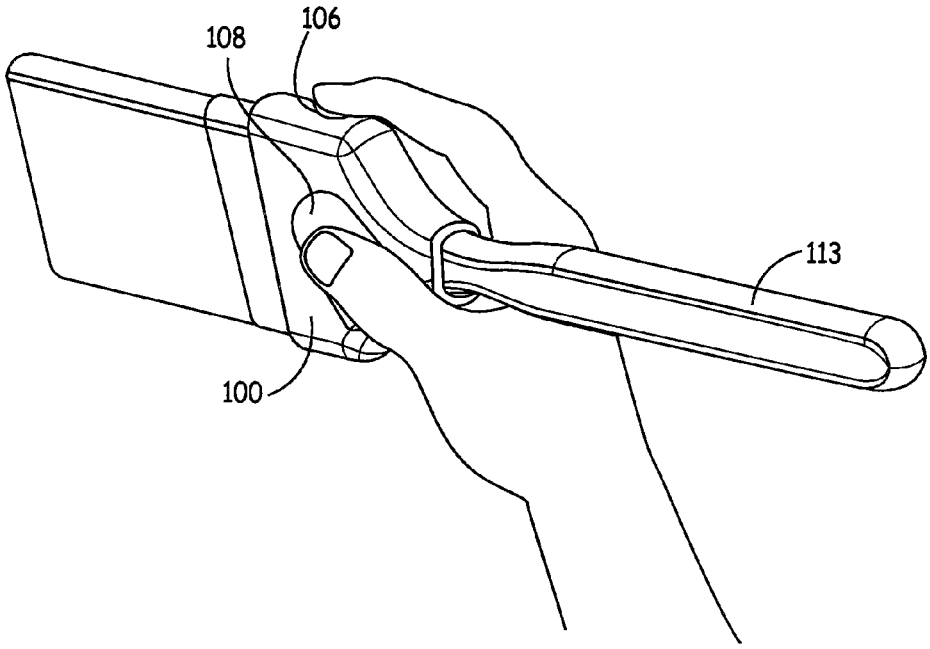
FIG. 4 is a perspective view of the embodiment of FIGS. 1-3, depicting the embodiment in use for a right-handed user, with the left-hand face of the sleeve being visible.
Figure 5:
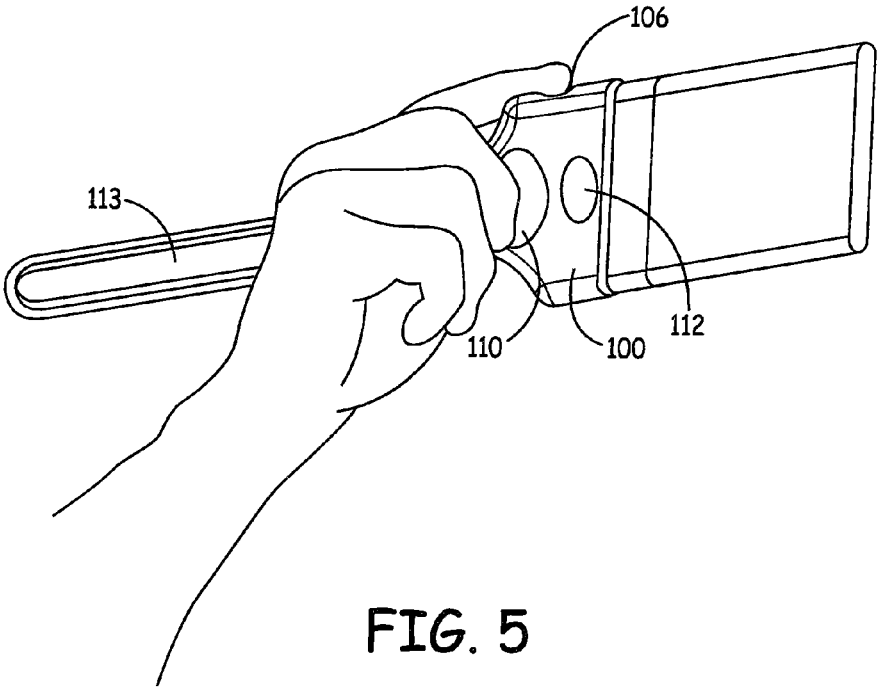
FIG. 5 is a perspective view of the embodiment of FIGS. 1-3, showing the user's hand in a first position.
Figure 6:
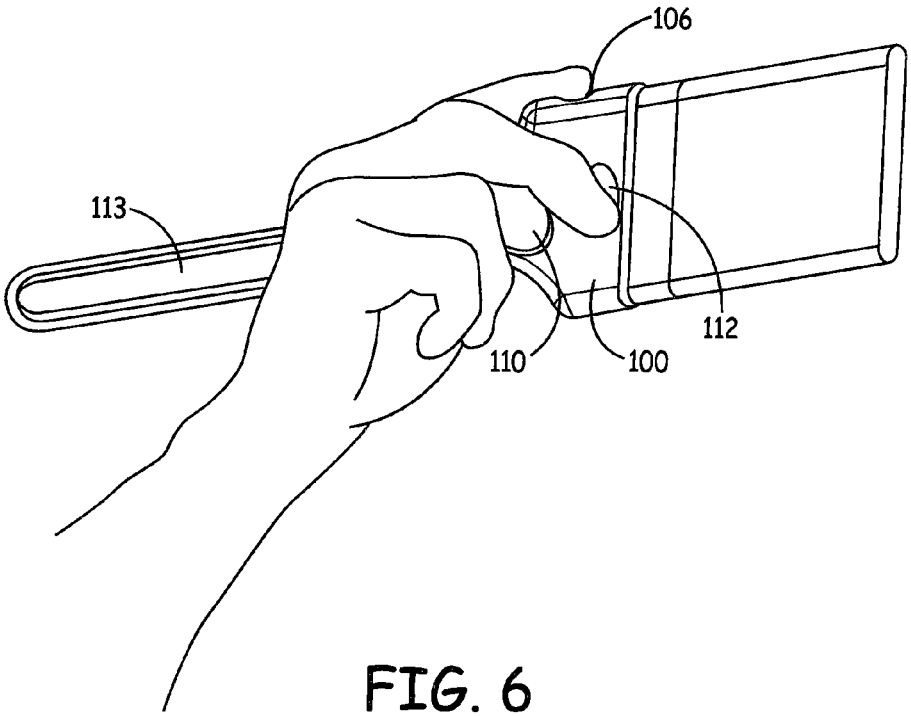
FIG. 6 is a perspective view of the embodiment of FIG. 5, depicting an alternative placement of the user's hand.

FIG. 4 depicts sleeve 100 in use for a right-handed user. Sleeve 100 is in a secure position on brush 113. The user's thumb is in thumb guide 108, the user's index finger is in index guide 106, and the user's middle finger is in one of the two middle finger positions (not shown). FIG. 5 depicts the use of FIG. 4 with the user's middle finger in first middle finger guide 110. FIG. 6 depicts the use of FIG. 4 with the user's middle finger in distal middle finger guide 112.

The various guides are depicted with particular shapes. Other shapes can also be used, and the disclosure is not to be limited to one such shape. Other shapes include circles, ovals, dish-shapes, and so forth. Artisans will appreciate that the term guide is broad and refers to a distinct area that can accommodate a portion of the user's digit to help direct the user's attention to the guide and then provide a means to help keep the digit in place. Such means may be, for example, chosen from the group consisting of a change in height, a change in texture, a ridge, a depression, a slot, a bump, a no-skid material, and a material distinct from an adjacent material.

Figure 7A:
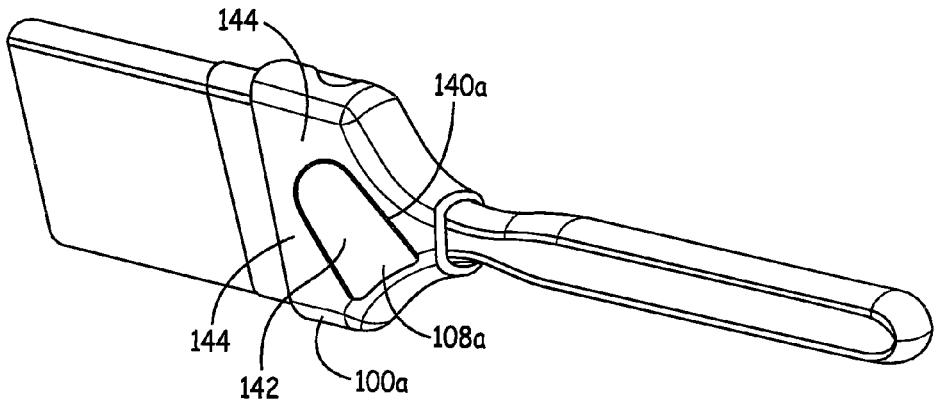
FIG. 7A is a perspective view of an embodiment depicting an alternative guide.
Figure 7B:
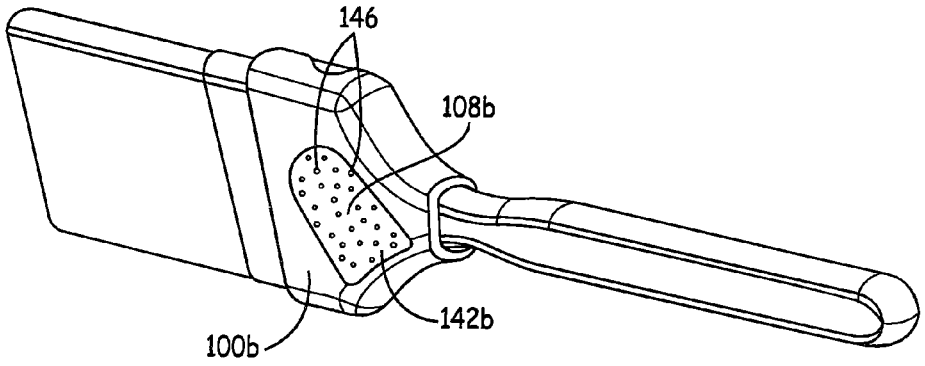
FIG. 7B is a perspective view of an embodiment depicting an alternative guide.
Figure 7C:
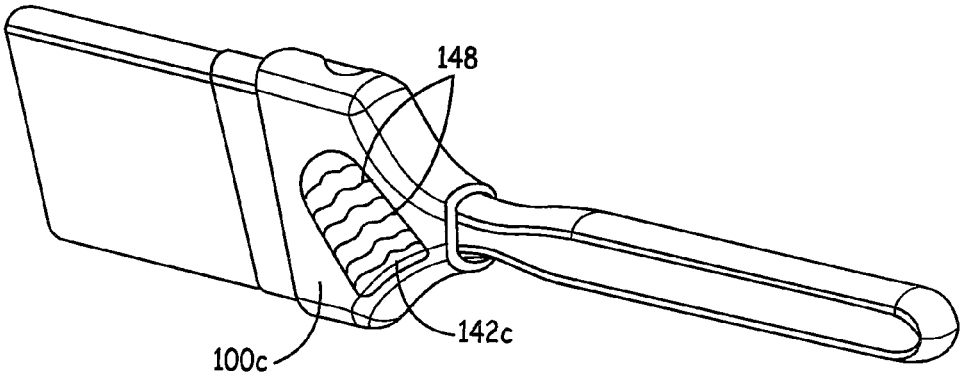
FIG. 7C is a perspective view of an embodiment depicting an alternative guide.
Figure 7D:
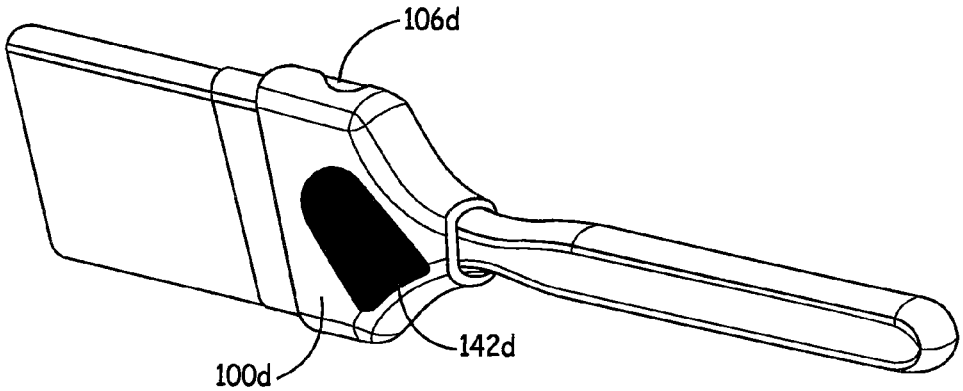
FIG. 7D is a perspective view of an embodiment depicting an alternative guide.

Guides 106, 108, 110, 112 may be formed as depressions in the sleeve or brush. The depressions may be substantially smooth with no inflection points. Alternatively, the depressions may have flat bottom portion with sides that taper down into the bottom portion. Further, ridges may be formed around the depressions, either in addition to a depression or as an alternative thereto. All of the guides may have the same features, or the various guides may have any combination of these features. For instance, FIG. 7A depicts thumb guide 108*a* with ridge 140 bounding a portion of guide 108*a*. Interior 142 of guide 108*a* is substantially continuous with the surrounding parts 144 of sleeve 100*a*, so that the guide is essentially defined by ridge 140*a*. An alternative embodiment is to make interior 142 as an area that is depressed relative to surrounding portions 144. One or more of said guides may have a textured surface that either defines the guide or is added in addition to one or more of the other features, e.g., a ridge, a depression, a depression with tapered sides and so forth. For instance, FIG. 7B depicts sleeve 100*b* with a guide, specifically a thumb guide defined by its interior 142*b*, with a plurality of bumps 146 that provide a texture that a user can readily identify as defining a guide. Alternatives are a series of ridges 148, as in FIG. 7C, showing a thumb guide thereby defined by interior 142*c* in sleeve 100*c*. Another alternative is the use of colors that are distinct from the sleeve to demarcate the guides. FIG. 7D depicts an embodiment comprising guides 142*d* and 106*d* that have a second material that is in contrast to other portions of sleeve 100*d* that are made of a first material. For example, the first material may be an engineering plastic and the second material may be a relatively softer elastomeric material. Overmolding techniques are well known for placing a second softer material over a base material. Examples of elastomeric materials are SANTOPRENE, silicone rubbers, neoprene, or simply a plastic with a lower durometer than the sleeve. Again, this particular feature may be used for one or more of the guides or in combination with one or more other features, such as a texture, ridges, a depression, and so forth.

Moreover, one or more guides and/or the sleeve may feature a label or a symbol indicating the role of the guide, with instructions being further provided in combination with the sleeve or brush. Thus a thumb guide could be labeled "thumb" or "T" or an arbitrary text or symbol that is explained with instructions. The other guides may be labeled "index", "middle", and so forth. The guides and/or the brush and/or the sleeve may further comprise indicia to indicate to a user what digits are to be placed in which guide. For example the words "thumb", "index", and/or "middle" may be used. Icons or graphics may be used. Numbers and/or icons or graphics may be used that are accompanied by instructions provided on the sleeve and/or brush and/or associated packaging.

The sleeve, or the brush that directly receives a guide, may have one or more of the guides. For instance, only a thumb guide could be provided, or only a thumb and a middle finger guide. Artisans will immediately appreciate that all of the above combinations and subcombinations of guides and guide features are contemplated.

The brush can have many alternative shapes and sources of manufacture as is well known in these arts. The sleeve may accordingly be adapted to fit any such brush. Brushes, however, have a significant degree of uniformity in sizing and shape in the present marketplace. It is possible to fit a large proportion of commonly sold brushes with a limited number of sleeve sizes.

The sleeve may be made of a pliable material, e.g., a rubber, elastic, or flexible plastic. The sleeve may alternatively be made of a rigid material, e.g., various engineering plastics. Examples of engineering plastics are polyethylene, polypropylene, ABS, polyurethane, polycarbonate, and polyetheretherketone. An overmolded elastomeric material may optionally be included. The guide may be a single piece or may be made of two or more members that are fastened together to fit around a brush.

The Figures depict a sleeve that comprises the guide. The guides may be placed directly on the brush as an alternative. Artisans reading this disclosure will immediately appreciate where and how to place the guides on the brush, including use of the many embodiments for the same described herein, such as different shapes, different materials, overmolding, elastomeric guides, and so forth. Artisans will immediately appreciate how to make and use sleeves for other brushes and how to add guides to existing brushes.

Other patents and patent applications are hereby incorporated by reference herein for all purposes; in case of conflict, the instant specification controls. These are: U.S. Pat. No. 6,145,151, U.S. Pat. No. 6,401,290, U.S. Pat. No. 6,138,313, U.S. Pat. No. 4,495,669, U.S. Pat. No. 3,819,779, U.S. Pat. No. 3,153,801, U.S. Pat. No. 3,023,439, U.S. Pat. No. 5,761,767, U.S. Pat. No. 5,556,092, U.S. Pat. No. 5,343,585, U.S. Pat. No. 4,751,762, U.S. Pat. No. 4,495,669, U.S. Pat. No. 4,490,875, U.S. Pat. No. 4,481,689, U.S. Pat. No. 4,454,623, U.S. Pat. No. 5,920,943, U.S. Pat. No. 5,761,759, U.S. Pat. No. 5,615,445, U.S. Pat. No. 5,446,941, U.S. Pat. No. 5,339,482, U.S. Pat. No. 4,751,762, and U.S. Pat. No. 4,495,669.

The invention claimed is:

1. A sleeve for partially covering a paint brush, the sleeve comprising a first substantially flat face and a second substantially flat face joined to each other by side faces, a first opening for receiving a ferrule of a paint brush and a second opening for receiving a shank portion of the paint brush, and at least one guide comprising an elastomeric material, with said guide being chosen from the group consisting of a thumb guide, an index finger guide, and a middle finger guide wherein said elastomeric material provides a visually or tactilely distinct area of the sleeve and has a size proportionate to a portion of a digit to thereby position the digit at a particular location on the guide, said digit being a thumb for the thumb guide, an index finger for the index finger guide and a middle finger for the middle finger guide.

2. The sleeve of claim 1 comprising the thumb guide.

3. The sleeve of claim 2 with the thumb guide being positioned at least partially over the ferrule when the sleeve is on a brush.

4. The sleeve of claim 2 wherein the handle has a central axis passing through the center of the shank, wherein an angle measured from the distal tip of the axis to the thumb guide is in a range from about 30 to about 60 degrees.

5. The sleeve of claim 2 with the thumb guide providing a location for a phalangeal portion of a thumb of a user.

6. The sleeve of claim 2 wherein the thumb guide is on the first face of the sleeve and further comprising a middle finger guide for a middle finger, with the middle finger guide being on the second face of the sleeve.

7. The sleeve of claim 6 wherein the middle finger guide is a first middle finger guide and further comprising a second middle finger guide.

8. The sleeve of claim 2 further comprising an index finger guide, with the thumb guide being on the first face of the sleeve and the index finger guide being on a side face of the sleeve.

9. The sleeve of claim 8 wherein the index finger guide is distal to the thumb guide.

10. The sleeve of claim 1 comprising a first and second portion that are fastenable to each other to form the sleeve.

11. A method of using the sleeve of claim 1 comprising placing the sleeve on the paint brush and placing a thumb and/or finger into a thumb or finger guide.

12. A process of making the sleeve of claim 1 comprising molding the sleeve and overmolding an elastomeric material onto the sleeve, the elastomeric material defining at least one guide chosen from the group consisting of a thumb guide, an index finger guide, and a middle finger guide.

13. A sleeve for partially covering a paint brush, the sleeve comprising a first substantially flat face and a second substantially flat face joined to each other by side faces, a first opening for receiving a ferrule of a paint brush and a second opening for receiving a shank portion of the paint brush, and at least one guide chosen from the group consisting of a thumb guide, an index finger guide, and a middle finger guide wherein each said guide is a visually or tactilely distinct area of the sleeve and has a size proportionate to a portion of a digit to thereby position the digit at a particular location on the guide, said digit being a thumb for the thumb guide, an index finger for the index finger guide and a middle finger for the middle finger guide.

14. The sleeve of claim 13 wherein the at least one guide is a distinct area of the sleeve defined by a feature chosen from the group consisting of a depression and a ridge.

15. The sleeve of claim 13 wherein the at least one guide is a distinct area of the defined by a texture.

16. The sleeve of claim 13 wherein the at least one guide is a distinct area of the sleeve visually or tactilely defined by a feature chosen from the group consisting of a color, and a material distinct from other portions of the sleeve.

17. The sleeve of claim 13 with the thumb guide being positioned at least partially over the ferrule when the sleeve is on a brush.

18. The sleeve of claim 13 wherein the thumb guide is on the first face of the sleeve and further comprising a middle finger guide for a middle finger, with the middle finger guide being on the second face of the sleeve.

19. The sleeve of claim 18 further comprising an index finger guide, with the thumb guide being on the first face of the sleeve and the index finger guide being on a side face of the sleeve.

20. A hand-held paint brush comprising a handle having a shank portion and a wide portion, a filament, and a ferrule secured to the wide portion and contacting the filament, with the paint brush comprising a thumb guide, an index finger guide, and a middle finger guide, wherein each said guide is a visually or tactilely distinct area of the brush and has a size proportionate to a portion of a digit to thereby position the digit at a particular location on the guide, said digit being a thumb for the thumb guide, an index finger for the index finger guide and a middle finger for the middle finger guide.

21. The brush of claim 20 wherein the at least one guide is a distinct area of the brush defined by a texture.

22. The brush of claim 20 wherein the at least one guide is a distinct area of the brush defined by a feature chosen from the group consisting of a depression, a ridge, a color, and a material distinct from other portions of the sleeve.

23. A sleeve for partially covering a paint brush, the sleeve comprising a first substantially flat face and a second substantially flat face joined to each other by side faces, a first opening for receiving a ferrule of a paint brush and a second opening for receiving a shank portion of the paint brush, and a thumb guide and an index finger guide, the first face of the sleeve comprises the thumb guide and a side face of the sleeve comprises the index finger guide.

* * * * *